United States Patent [19]

Choate, Jr.

[11] 3,982,449

[45] Sept. 28, 1976

[54] PORTABLE POWER OPERATED PIPE WRENCH

[76] Inventor: Frank J. Choate, Jr., 3465 Arbon St., Salem, Oreg. 97303

[22] Filed: Nov. 10, 1975

[21] Appl. No.: 630,656

[52] U.S. Cl. ..... 81/57.18

[51] Int. Cl.[2] ..... B25B 17/00

[58] Field of Search..... 81/57.18, 57.19, 57.20, 81/57.21, 57.15

[56] References Cited

UNITED STATES PATENTS

| | | | |
|---|---|---|---|
| 2,544,639 | 3/1951 | Calhoun | 81/57.2 X |
| 2,746,329 | 5/1956 | Paget | 81/57.19 X |
| 3,892,148 | 7/1975 | Wiley | 81/57.18 |

*Primary Examiner*—James L. Jones, Jr.
*Attorney, Agent, or Firm*—Eugene M. Eckelman

[57] ABSTRACT

A hollow member having a longitudinally movable yoke pivotally supporting pipe engaging arms. Rearward ends of the arms have roller engagement with a ramp in the body member, and upon powered longitudinal movement of the yoke, the arms are movable between an outer open position for receiving a pipe and an inner position holding the pipe against a toothed drive wheel. The drive wheel is connected by a shaft and gearing to a drive socket arranged to be driven by a conventional impact wrench. Powered operation of the yoke in the longitudinal direction is by a fluid operated cylinder and piston assembly.

8 Claims, 6 Drawing Figures

PORTABLE POWER OPERATED PIPE WRENCH

BACKGROUND OF THE INVENTION

This invention relates to a new and novel portable power operated pipe wrench.

Powered pipe wrenches have heretofore been provided such as illustrated in U.S. Pat. No. 2,544,639 and in U.S. Pat. No. 2,523,913. Such structures were designed for their particular purpose but were not designed to be used for general usage by tradesmen or any other trade that requires portability of the tool and use in confined spaces. That is, the prior tools are bulky and many of them generally require mounting on a support. These prior devices also have complex structure and thus are not feasible for general usage.

SUMMARY OF THE INVENTION

According to the present invention and forming a primary objective thereof, a power pipe wrench is provided that is portable in order that it can have general usage by tradesmen, and furthermore is designed such that it can be used in confined areas.

In carrying out the objectives of the invention, the tool includes a body member and longitudinally movable yoke means therein which operates pipe engaging arms. These arms when actuated draw the pipe in against a toothed wheel driven by outside power means such as an impact wrench. The pipe engaging arms have roller engagement on a wedge shaped ramp within the tool, and movement of the arms between an outer open position and an inner pipe engaging position is accomplished by a fluid operated piston and cylinder assembly connected to the yoke means.

In addition to being portable and being usable by general tradesmen, the present powered pipe wrench is simplified in construction and rugged in operation.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 1:
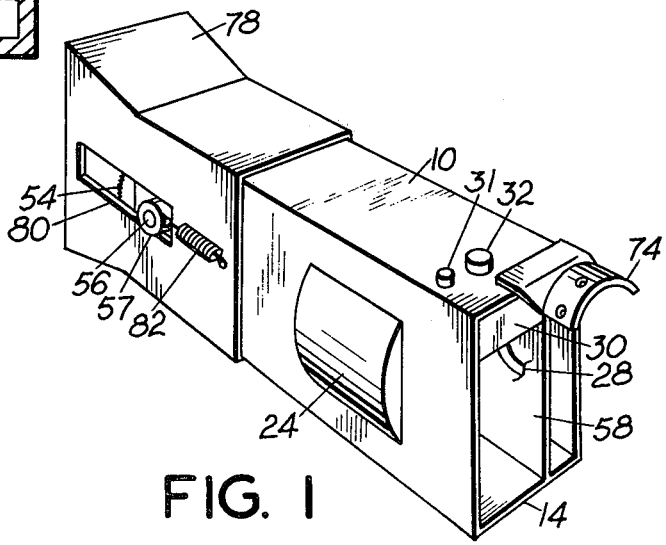
FIG. 1 is a perspective view of the present powered pipe wrench, this view being in reduced size relative to the other views.
Figure 3:
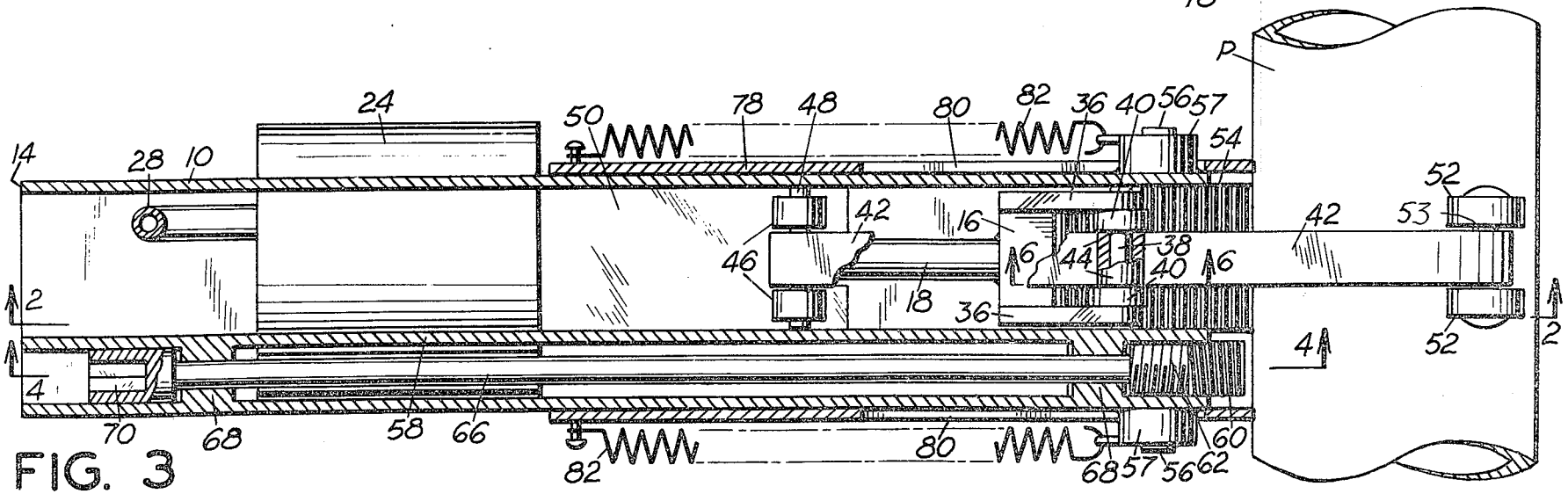
FIG. 3 is a horizontal sectional view taken on the line 3—3 of FIG. 2, this view being partly broken away for clarity.

Referring with particularity to the drawings, the present wrench comprises a hollow body member or housing 10 having open forward and rearward ends 12 and 14, respectively. A yoke or head 16 is secured on the end of a piston rod 18 integral with a piston head 20 operable longitudinally of the tool in a fluid operated cylinder 22. This cylinder comprises an integral part of the body member 10, and as seen in FIGS. 1 and 3, the body member may be contoured at 24 to accommodate the round cylinder. A compression spring 26 in the cylinder 22 engages the piston head 20 and urges such head and piston rod 18 forwardly, and a fluid inlet conduit 28 is connected into the forward end of the cylinder in order that fluid pressure when admitted into the cylinder will drive the piston head rearwardly. Conduit 28 leads rearwardly into a control valve 30 secured to the body member and having an on-off operating button 32 projecting through the body member for engagement by the operator. Conduit 28 is fed from a suitable source of pressured fluid, such as an air compressor, not shown, and by the arrangement shown, the yoke 16 will normally be urged in a forward position by the spring 26 but is retractible against the force of the spring by fluid pressure admitted into the cylinder upon opening of valve 30. Control valve 30 also has a regulating valve with adjusting knob 31 to control the pressure to be applied to the piston. The structure of valve 30 with its on-off button 30 and regulating means 31 is conventional and is not detailed.

Figure 4:
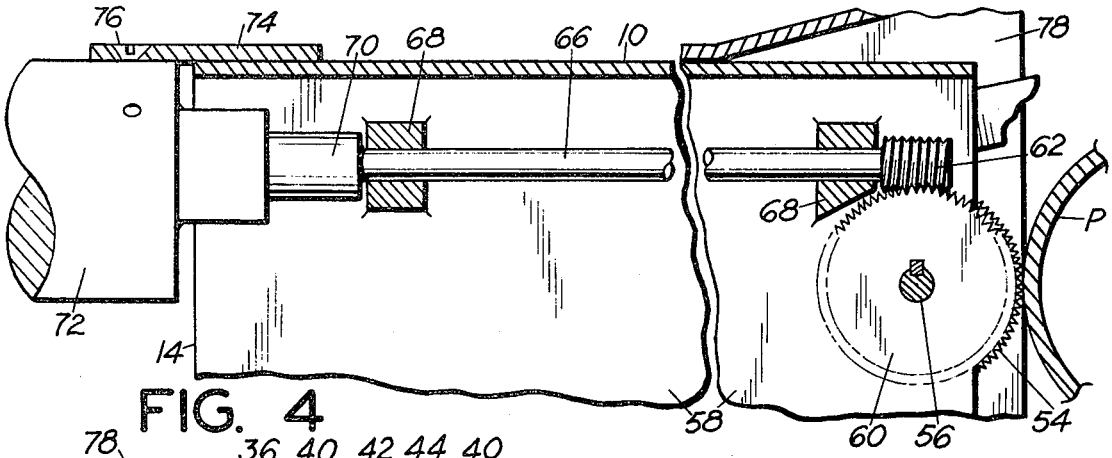
FIG. 4 is a foreshortened vertical longitudinal sectional view taken on the line 4—4 of FIG. 3.
Figure 5:
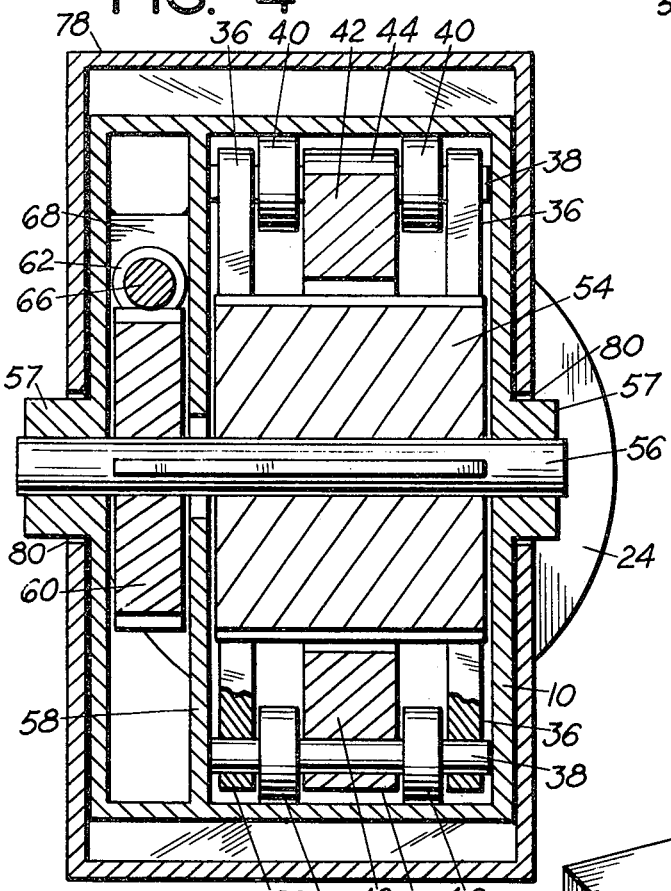
FIG. 5 is an enlarged vertical cross sectional view taken on the line 5—5 of FIG. 2.
Figure 6:
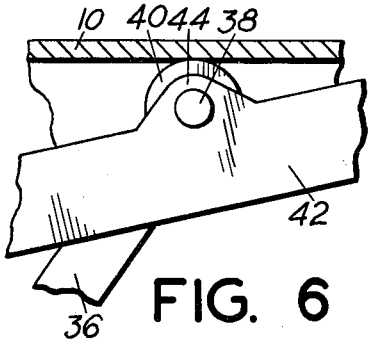
FIG. 6 is an enlarged fragmentary sectional view taken on the line 6—6 of FIG. 3.
Figure 2:
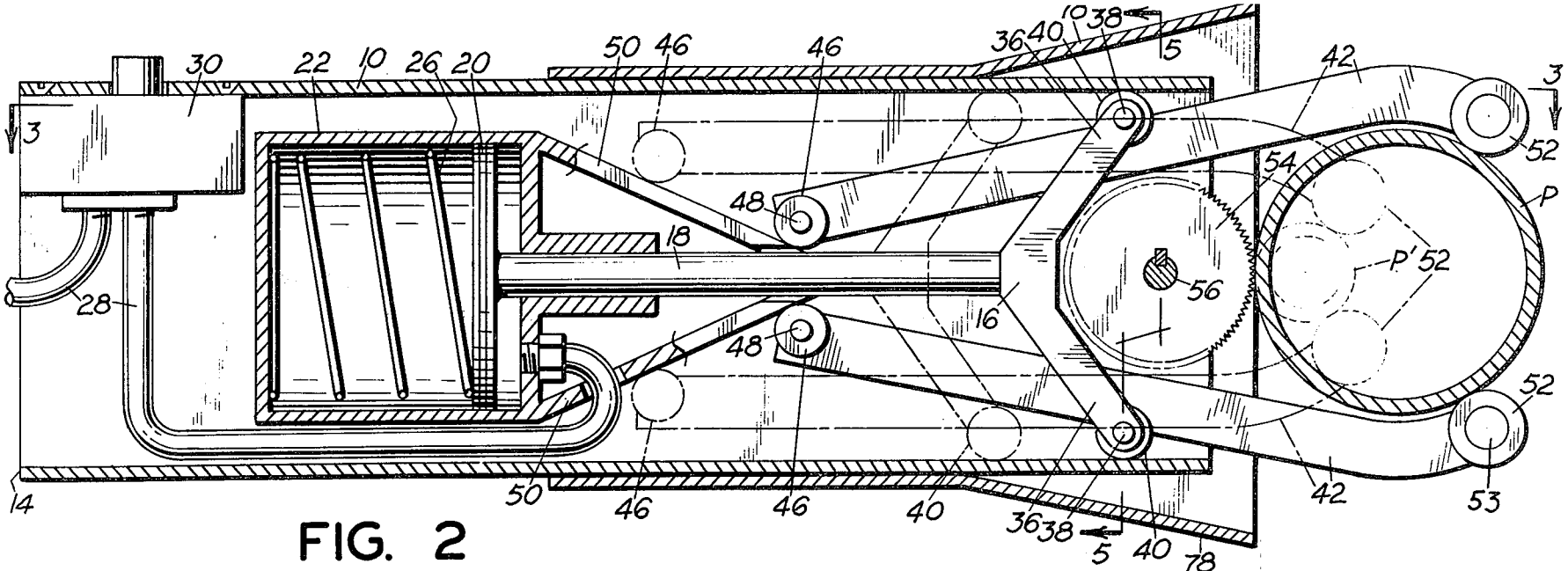
FIG. 2 is a vertical longitudinal sectional view taken on the line 2—2 of FIG. 3.

Yoke 16 has pairs of laterally projecting arms 36. Supported between each pair of arms is a shaft 38 which in turn supports a pair of wheels 40 and a pipe engaging arm 42, the arm 42 having an apertured ear 44, best seen in FIG. 6, integral therewith for journaled engagement with the shaft 38. The parts are dimensioned and arranged such that as seen in FIG. 2 the pairs of wheels 40 in the longitudinal movement of the yoke have rolling engagement against respective inner surfaces of the body member 10.

Each of the pipe engaging arms 42 at the rearward end thereof supports rollers 46 thereon by means of cross shafts 48, and these rollers are engageable with a wedge-shaped ramp 50 extending longitudinally from the cylinder 22 in integral relation therewith and with the body member at the sides. Upon longitudinal movement of the yoke 16 in a rearward direction, the two sets of rollers 46 are driven along their respective ramp portions 50 to pivot the arms in the direction such that the forward ends thereof move toward each other. The forward ends of arms 42 carry rollers 52 on shafts 53 for engagement with a pipe P to be rotated in a function to be described in greater detail hereinafter.

Mounted in the body member adjacent the front thereof is a toothed drive roller 54 keyed on a cross shaft 56 supported in journaled engagement in hub portions 57 in the side walls of the body member. Also keyed to the shaft 56 and disposed in a side compartment of the housing formed by a longitudinal wall 58 is a gear 60 having meshing engagement with a worm gear 62 secured on the forward end of a longitudinally extending shaft 66 journaled at spaced points 68 in the body member. The rearward end of the shaft 66 has a socket 70 and this socket receives the the drive head of a power driven tool such as an air operated impact wrench 72. A mounting bracket 74 is secured to the rearward end of the body member 10 and has suitable removable securement to the impact wrench as by screws 76. The impact wrench 72, being rigidly secured to the body member 10 can assist as holding means for the pipe wrench in the use of the latter but can be removed if desired if it is to be used for other purposes.

A guard 78 is slidably mounted on the forward end of the body member 10 and has side slots 80 to receive the side hubs 57, the slots 80 opening through the front of the guard. A tension spring 82 is connected between each hub 57 and the rear wall of the associated slots 80 to normally urge the guards 78 in their outer position but allowing them to retract during operation of the pipe wrench.

In the operation of the present tool, it is moved forwardly onto the pipe, the cylinder 22 being at rest at this time wherein the piston rod 18 together with the yoke 16 and arms 42 is disposed forwardly. At this time the rollers 46 of the arms 42 are forward on the ramp 50 and the outer ends of the arms are open to readily receive the pipe P. In moving the wrench onto a pipe, the guard 78 engages the pipe and retracts against the force of springs 82, and when the wrench has been placed frontwise against the pipe, the operator opens the valve 30 by depressing the operating button 32. Fluid pressure is thus admitted to the front of the cylinder and the piston head 20 retracts whereby the rollers 46 of arms 42 move up the ramp 50 and close down the outer ends of the arms so that their rollers 52 engage the pipe and pull the tool into a position on the pipe such that the drive roller 54 is in firm engagement with the pipe. Such a position of the wrench on a rather large pipe P is shown in FIG. 2. To rotate the pipe, the operator while depressing the operating button 32 simultaneously pulls the trigger of the impact wrench 72 to rotate the shaft 66. Impact wrench 72 is reversible and may be rotated in either direction. The drive roller 54 thus rotates the pipe P for the desired purpose. Upon completion of the driving function, the operator releases the button 32 whereby the spring 26 in the cylinder automatically drives the arms 42 outwardly to disengage them from the pipe. Operation of the piston cylinder assembly and the impact wrench can be operated by the same pressure air system by suitable fittings.

FIG. 2 shows in broken lines the versatility of the present wrench for use on different sizes of pipes. That is, a small pipe P′ can be rotatably driven in the same manner as the larger pipe, and this is accomplished merely by further retraction of the piston rod 18 and yoke 16 for moving the rearward ends of the arms 42 further up the ramp 50. As with the larger pipes, the outer rollers 52 of the arms 42 hold the pipe against the drive roller 54.

According to the present invention, a powered pipe rotating wrench is provided which is of the portable type and readily engageable with pipes that may exist in installed positions. In order to engage a pipe, the wrench is merely moved forwardly over the pipe and thus it can engage pipes in extremely confined areas. It will fit a large variety of pipe sizes and has three point engagement with the pipe, namely, between upper and lower wheels 52 and the drive roller 54, to provide for positive engagement and turning drive of the pipe. The amount of pressure to be exerted on the pipe is adjustable by selected settings of adjusting knob 31.

It is to be understood that the form of my invention herein shown and described is to be taken as a preferred example of the same and that various changes in the shape, size and arrangement of parts may be resorted to without departing from the spirit of my invention or the scope of the subjoined claims.

Having thus described my invention, I claim:

1. A portable power operated pipe wrench, comprising a. a tubular body housing having forward and rearward ends, b. longitudinally movable yoke means slidably mounted in said housing in extending and retracting movements, c. power means for driving said yoke means longitudinally, d. a pair of opposed pipe engaging arms pivotally supported on said yoke means, e. said arms having front pipe engaging ends arranged to engage a pipe in a closing pivoted positioning of said arms and to receive and release a pipe in an opening pivoted positioning, f. a drive roller in said housing arranged to be brought into engagement with a pipe in the closing pivoted positioning of said arms, g. guide means in said housing engageable by the rearward ends of said arms arranged to pivot said arms to their closing pivoted positioning in a retracted position of said yoke means and to pivot said arms to their opening pivoted positioning in an extended position of said yoke means, h. and drive receiving means in said housing connected with said drive roller arranged for driving connection with an outside power source.

2. The portable power operated pipe wrench of claim 1 wherein said guide means comprises a wedge-shaped ramp.

3. The portable power operated pipe wrench of claim 1 wherein said guide means comprises a wedge-shaped ramp and said pipe engaging arms have roller means engageable with said ramp.

4. The portable power operated pipe wrench of claim 1 wherein said yoke means includes a pair of diverging arms supporting respective pipe engaging arms, and rollers on said arms having rolling engagement with an interior of said casing.

5. The portable power operated pipe wrench of claim 1 wherein said front pipe engaging ends of said arms comprise rollers.

6. The portable power operated pipe wrench of claim 1 wherein said power means for driving said yoke means longitudinally comprises a fluid operated piston and cylinder assembly secured in said housing.

7. The portable power operated pipe wrench of claim 1 wherein said drive receiving means includes a socket for removably receiving a powered impact wrench.

8. The portable power operated pipe wrench of claim 1 having a walled guard slidable on the front end thereof and arranged to project beyond said front ends, said guard having side slots for receiving a pipe to be turned.

* * * * *